US009423087B2

(12) United States Patent
Yamamoto

(10) Patent No.: US 9,423,087 B2
(45) Date of Patent: Aug. 23, 2016

(54) VEHICULAR LAMP

(71) Applicant: KOITO MANUFACTURING CO., LTD., Tokyo (JP)

(72) Inventor: Ippei Yamamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 81 days.

(21) Appl. No.: 14/457,253

(22) Filed: Aug. 12, 2014

(65) Prior Publication Data

US 2015/0043236 A1 Feb. 12, 2015

(30) Foreign Application Priority Data

Aug. 12, 2013 (JP) ..... 2013-167562

(51) Int. Cl.

| | |
|---|---|
| ***F21S 8/10*** | (2006.01) |
| ***F21K 99/00*** | (2016.01) |
| *F21Y 101/02* | (2006.01) |

(52) U.S. Cl.

CPC ..... *F21S 48/1225* (2013.01); *F21K 9/50* (2013.01); *F21S 48/1104* (2013.01); *F21S 48/1159* (2013.01); *F21S 48/137* (2013.01); *F21S 48/211* (2013.01); *F21S 48/215* (2013.01); *F21S 48/234* (2013.01); *F21Y 2101/02* (2013.01)

(58) Field of Classification Search

CPC ..... F21K 9/50; F21S 48/1104; F21S 48/137; F21S 48/215; F21S 48/1225; F21S 48/234; F21S 48/211; F21S 48/1159; F21S 48/115; F21S 48/13; F21S 48/1311; F21S 48/1388; F21S 48/23; F21Y 2101/02; F21V 7/0025; F21V 7/0083; F21V 7/06

See application file for complete search history.

(56) References Cited

U.S. PATENT DOCUMENTS

| | | | | |
|---|---|---|---|---|
| 7,722,235 | B2 * | 5/2010 | Mochizuki | F21S 48/1159 362/538 |
| 8,920,009 | B2 * | 12/2014 | Park | F21S 48/1311 362/296.01 |
| 9,188,297 | B2 * | 11/2015 | Naganawa | F21S 48/1104 |
| 2004/0120158 | A1 * | 6/2004 | Tatsukawa | B60Q 1/04 362/509 |
| 2012/0065760 | A1 * | 3/2012 | Yagi | G02B 27/0012 700/103 |

FOREIGN PATENT DOCUMENTS

| | | | |
|---|---|---|---|
| CN | 102635821 | A | 8/2012 |
| CN | 102829436 | A | 12/2012 |
| CN | 202938188 | U | 5/2013 |
| JP | 2011-081975 | A | 4/2011 |

OTHER PUBLICATIONS

Office Action issued in corresponding Chinese Application No. 201410394826.0, mailed on Mar. 7, 2016 (18 pages).

* cited by examiner

*Primary Examiner* — Bao Q Truong
(74) *Attorney, Agent, or Firm* — Osha Liang LLP

(57) ABSTRACT

A vehicular lamp has a light source attachment flat surface having a plurality of light source attachment portions, a plurality of light sources attached to the plurality of light source attachment portions, and a plurality of parabolic reflectors. Each of the plurality of parabolic reflectors reflect light from a corresponding one of the light sources in a predetermined optical axis direction. The light source attachment flat surface is tilted with respect to an optical axis of the reflector so as to be higher on a front side of the lamp than on a rear side of the lamp.

5 Claims, 8 Drawing Sheets

VEHICULAR LAMP

BACKGROUND

1. Technical Field

The present invention relates to vehicular lamps, and more particularly to vehicular lamps using a light-emitting element such as an LED and a parabolic reflector.

2. Related Art

Conventionally, vehicular lamps are known which are formed by a plurality of LEDs and a plurality of reflectors each reflecting light from a corresponding one of the LEDs (see, e.g., Patent Document 1).

Patent Document 1

Japanese Patent Application Laid-Open (Kokai) No. 2011-81975

SUMMARY

In the case of forming vehicular lamps using an LED and a parabolic reflector, a flat surface to which the LED is attached (hereinafter referred to as the "light source attachment flat surface) is typically provided parallel to the optical axis of the reflector. If the LED and the reflector have a predetermined positional relation, a light ray is emitted in a predetermined optical axis direction of the reflector, and a light distribution pattern is formed at a predetermined position ahead of the vehicle.

However, if the attachment position of the LED is shifted from a predetermined position, the positional relation between the LED and the reflector changes, and the light ray may not be emitted in the predetermined optical axis direction, and the light distribution pattern may be shifted from the predetermined position.

One or more embodiments of the present invention provides a vehicular lamp capable of suppressing a shift in position of a light distribution pattern due to variation in attachment position of a light source.

A vehicular lamp according to one or more embodiments of the present invention includes: a light source attachment flat surface having a plurality of light source attachment portions to which a plurality of light sources are attached; and a plurality of parabolic reflectors each reflecting light from a corresponding one of the light sources in a predetermined optical axis direction. The light source attachment flat surface is tilted with respect to an optical axis of the reflector so as to be higher on a front side of the lamp than on a rear side of the lamp.

The light source attachment flat surface may have a first light source attachment portion to which a first light source is attached, and a second light source attachment portion to which a second light source is attached. The plurality of reflectors may include a first reflector that reflects light from the first light source, and a second reflector that reflects light from the second light source. The first reflector may extend from a front end of the second reflector toward a front of the lamp, and the first light source attachment portion and the second light source attachment portion may be placed on the light source attachment flat surface so that the first light source is placed at a focal point of the first reflector and the second light source is placed at a focal point of the second reflector. An f-number of a reflective surface of the second reflector may be smaller than an f-number of a reflective surface of the first reflector.

A vehicular lamp according to one or more embodiments of the present invention includes: a light source attachment flat surface having a first light source attachment portion to which a first light source is attached, and a second light source attachment portion to which a second light source is attached; a parabolic first reflector that reflects light from the first light source to a front of the lamp; and a parabolic second reflector that reflects light from the second light source to the front of the lamp. The first reflector extends from a front end of the second reflector toward the front of the lamp, and the first light source attachment portion and the second light source attachment portion are placed on the light source attachment flat surface so that the first light source is placed at a focal point of the first reflector and the second light source is placed at a focal point of the second reflector. An f-number of a reflective surface of the second reflector may be smaller than an f-number of a reflective surface of the first reflector.

According to one or more embodiments of the present invention, a vehicular lamp can be provided which is capable of suppressing a shift in position of a light distribution pattern due to variation in attachment position of a light source.

DETAILED DESCRIPTION

Embodiments of the present invention will be described in detail below with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. As used herein, the terms representing the directions such as "upper," "lower," "front," "rear," "left," "right," "inner," and "outer" mean the directions in an attitude of the vehicular lamp mounted on a vehicle.

Figure 1:
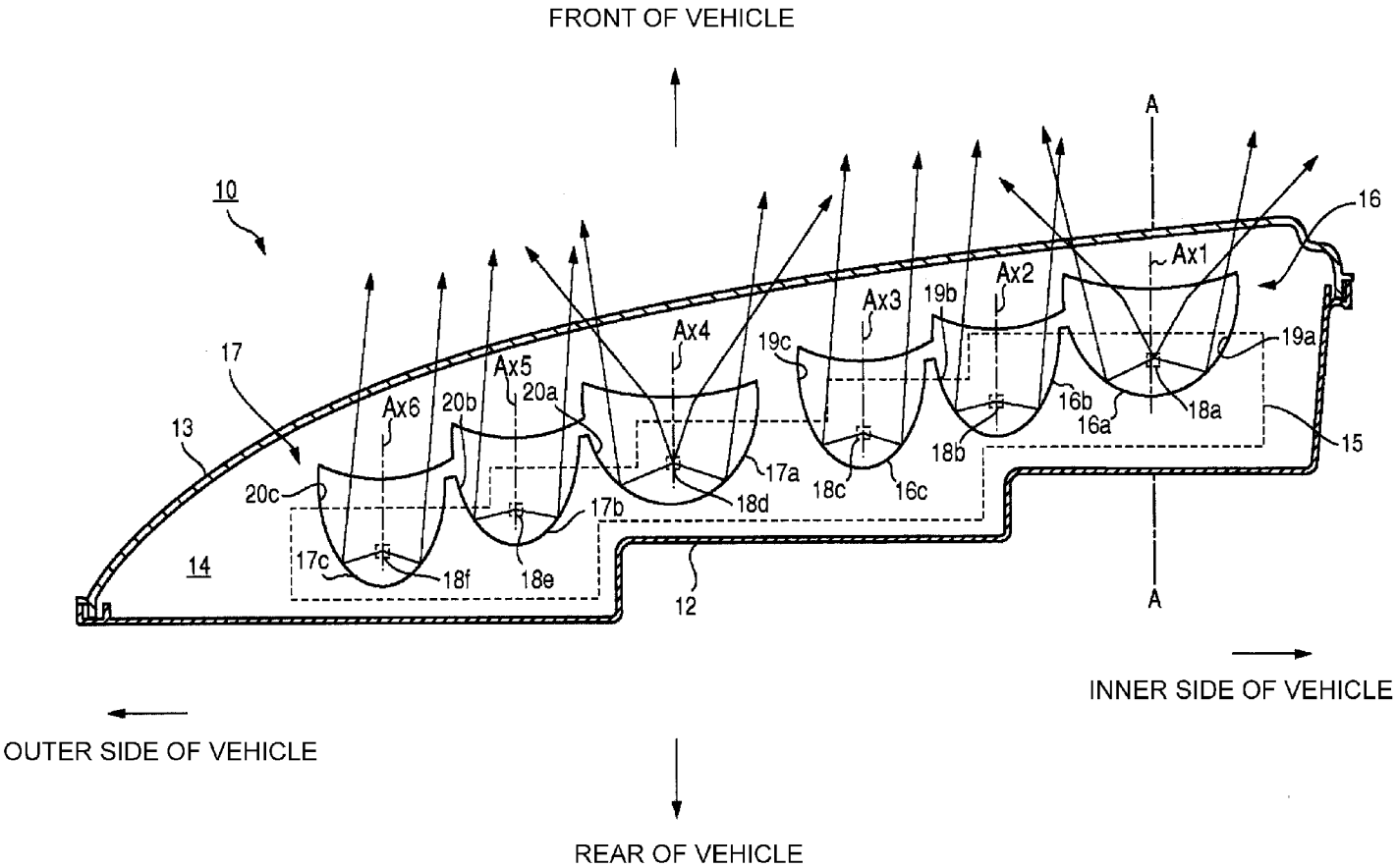
FIG. 1 is a schematic horizontal cross-sectional view of a vehicular lamp according to one or more embodiments of the present invention.
Figure 2:
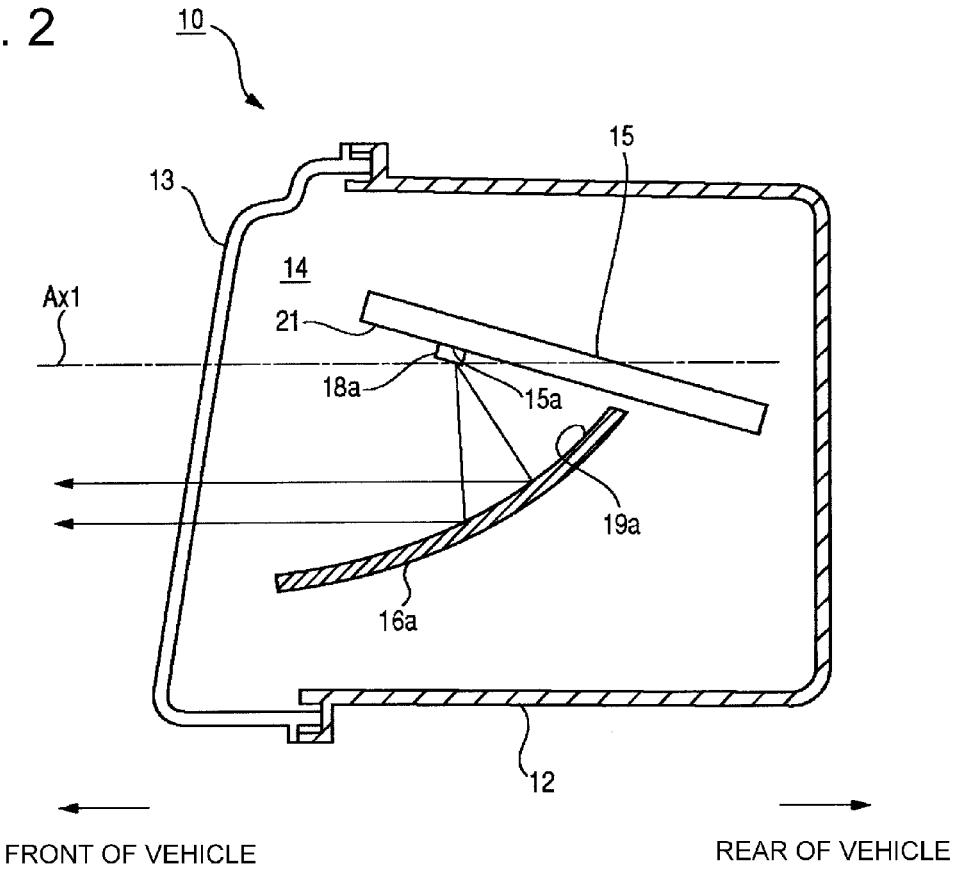
FIG. 2 is an A-A sectional view of the vehicular lamp shown in FIG. 1.

FIG. 1 is a schematic horizontal cross-sectional view of a vehicular lamp 10 according to an embodiment of the present invention. FIG. 2 is an A-A sectional view of the vehicular lamp 10 shown in FIG. 1. The vehicular lamp 10 shown in FIG. 1 is a single headlamp that is placed on each of the right and left sides of the front part of the vehicle. Since the right and left vehicular lamps have substantially the same structure, the structure of the vehicular lamp that is placed on the left side of the vehicle will be representatively described below.

As shown in FIGS. 1 and 2, the vehicular lamp 10 includes a lamp body 12 and a transparent outer cover 13 that covers an opening in the front of the lamp body 12. The lamp body 12 and the outer cover 13 form a lamp chamber 14. As shown in FIG. 1, the outer cover 13 is shaped to conform to a slant nose shape of the vehicle, and is tilted toward the rear of the vehicle from the inner side toward the outer side of the vehicle. The lamp body 12 is formed in a stepped configuration stepped toward the rear of the vehicle from the inner side toward the outer side of the vehicle according to the shape of the slanted outer cover 13. Accordingly, the lamp chamber 14 that is formed by the lamp body 12 and the outer cover 13 is a space tilted toward the rear of the vehicle from the inner side toward the outer side of the vehicle.

A circuit board 15, a high beam reflector unit 16, and a low beam reflector unit 17 are accommodated in the lamp chamber 14. Each of the circuit board 15, the high beam reflector unit 16, and the low beam reflector unit 17 is fixed to a lamp body 12 by a support member, not shown.

The circuit board 15 extends from the inner side toward the outer side of the vehicle in the upper part of the lamp chamber 14. As shown in FIG. 1, the circuit board 15 is formed in a stepped configuration stepped toward the rear of the vehicle from the inner side toward the outer side of the vehicle according to the shape of the slanted outer cover 13.

Six LEDs (first to sixth LEDs 18*a* to 18*f*) are mounted on the circuit board 15. Six light source attachment portions are formed on a light source attachment flat surface 21 as the lower surface of the circuit board 15 in order to mount these six LEDs thereon. Each light source attachment portion may be an electrode for soldering of an electrode of a corresponding one of the LEDs. FIG. 2 shows a first light source attachment portion 15*a* for attachment of the first LED 18*a*. The first to sixth LEDs 18*a* to 18*f* are supplied with a current from the circuit board 15 to emit light.

The first to third LEDs 18*a* to 18*c* are LEDs that are used to radiate high beams, and are mounted on the inner side of the vehicle with respect to the center of the circuit board 15. Of these three LEDs, the first LED 18*a* is provided on the innermost side of the vehicle, the second LED 18*b* is provided outside the first LED 18*a*, and the third LED 18*c* is provided outside the second LED 18*b*.

The fourth to sixth LEDs 18*d* to 18*f* are LEDs that are used to radiate low beams, and are mounted on the outer side of the vehicle with respect to the center of the circuit board 15. Of these three LEDs, the fourth LED 18*d* is provided on the innermost side of the vehicle, the fifth LED 18*e* is provided outside the fourth LED 18*d*, and the sixth LED 18*f* is provided outside the fifth LED 18*e*.

The high beam reflector unit 16 and the low beam reflector unit 17 are arranged side by side below the circuit board 15 in the lamp chamber 14. The high beam reflector unit 16 is placed on the inner side of the vehicle, and the low beam reflector unit 17 is placed on the outer side of the vehicle.

The high beam reflector unit 16 is a reflector group that is used to radiate high beams, and is formed by three parabolic reflectors, namely a high beam diffusing reflector 16*a*, a first high beam condensing reflector 16*b*, and a second high beam condensing reflector 16*c*. These three reflectors are formed integrally. Of these three reflectors, the high beam diffusing reflector 16*a* is provided on the innermost side of the vehicle, the first high beam condensing reflector 16*b* is provided outside the high beam diffusing reflector 16*a*, and the second high beam condensing reflector 16*c* is provided outside the first high beam condensing reflector 16*b*.

The high beam diffusing reflector 16*a*, the first high beam condensing reflector 16*b*, and the second high beam condensing reflector 16*c* respectively have reflective surfaces 19*a* to 19*c* each formed based on a paraboloid of revolution. The rotation central axis of each paraboloid of revolution is an optical axis of a corresponding one of the reflectors. That is, the high beam diffusing reflector 16*a* has a first optical axis Ax1, the first high beam condensing reflector 16*b* has a second optical axis Ax2, and the second high beam condensing reflector 16*c* has a third optical axis Ax3. The high beam diffusing reflector 16*a*, the first high beam condensing reflector 16*b*, and the second high beam condensing reflector 16*c* are placed so that the first optical axis Ax1, the second optical axis Ax2, and the third optical axis Ax3 extend in the longitudinal direction of the vehicle (horizontal direction).

The first LED 18*a* is placed at a focal point (located on the first optical axis Ax1) of the reflective surface 19*a* of the high beam diffusing reflector 16*a* (see FIG. 2). The second LED 18*b* is placed at a focal point (located on the second optical axis Ax2) of the reflective surface 19*b* of the first high beam condensing reflector 16*b*. The third LED 18*c* is placed at a focal point (located on the third optical axis Ax3) of the second high beam condensing reflector 16*c*. Each reflector reflects light from a corresponding one of the LEDs in a direction parallel to the optical axis.

The low beam reflector unit 17 is a reflector group that is used to radiate low beams, and is formed by three parabolic reflectors, namely a low beam diffusing reflector 17*a*, a first low beam condensing reflector 17*b*, and a second low beam condensing reflector 17*c*. These three reflectors are formed integrally. Of these three reflectors, the low beam diffusing reflector 17*a* is provided on the innermost side of the vehicle, the first low beam condensing reflector 17*b* is provided outside the low beam diffusing reflector 17*a*, and the second low beam condensing reflector 17*c* is provided outside the first low beam condensing reflector 17*b*.

The low beam diffusing reflector 17*a*, the first low beam condensing reflector 17*b*, and the second low beam condensing reflector 17*c* respectively have reflective surfaces 20*a* to 20*c* each formed based on a paraboloid of revolution. The rotation central axis of each paraboloid of revolution is an optical axis of a corresponding one of the reflectors. That is, the low beam diffusing reflector 17*a* has a fourth optical axis Ax4, the first low beam condensing reflector 17*b* has a fifth optical axis Ax5, and the second low beam condensing reflector 17*c* has a sixth optical axis Ax6. The low beam diffusing reflector 17*a*, the first low beam condensing reflector 17*b*, and the second low beam condensing reflector 17*c* are placed so that the fourth optical axis Ax4, the fifth optical axis Ax5, and the sixth optical axis Ax6 extend in the longitudinal direction of the vehicle (horizontal direction).

The fourth LED 18*d* is placed at a focal point (located on the fourth optical axis Ax4) of the reflective surface 20*a* of the low beam diffusing reflector 17*a*. The fifth LED 18*e* is placed at a focal point (located on the fifth optical axis Ax5) of the reflective surface 20*b* of the first low beam condensing reflector 17*b*. The sixth LED 18*f* is placed at a focal point (located on the sixth optical axis Ax6) of the second low beam condensing reflector 17*c*. Each reflector reflects light from a corresponding one of the LEDs in a direction parallel to the optical axis.

Figure 3:
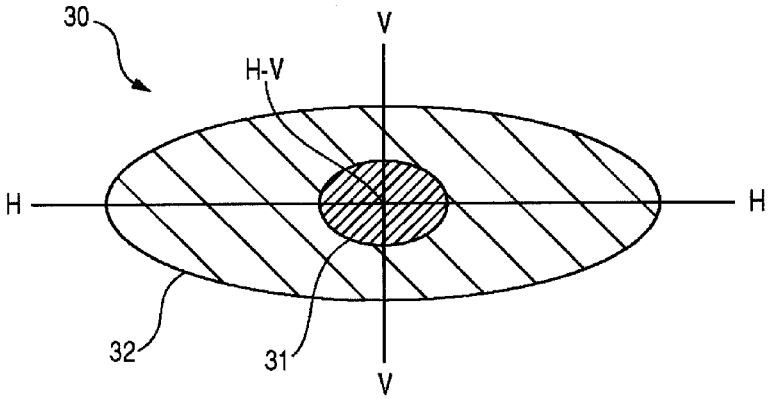
FIG. 3 is a diagram showing a high beam light distribution pattern that is formed ahead of the lamp by a high beam lamp unit.

In one or more embodiments of the present invention, the high beam reflector unit 16 and the first to third LEDs 18*a* to 18*c* form a high beam lamp unit that radiates high beams. FIG. 3 shows a high beam light distribution pattern 30 that is formed ahead of the lamp by the high beam lamp unit. The high beam light distribution pattern 30 shown in FIG. 3 is a light distribution pattern that is formed on an imaginary vertical screen positioned 25 m ahead of the vehicular lamp 10. FIG. 3 shows a vertical line V-V passing through a point H-V as a vanishing point in the forward direction of the lamp, and a horizontal line H-H passing through the point H-V.

A high beam condensed light distribution pattern 31 is formed around the point H-V by light reflected by the reflective surface 19*b* of the first high beam condensing reflector 16*b* after being emitted from the second LED 18*b* and light reflected by the reflective surface 19*c* of the second high beam condensing reflector 16*c* after being emitted from the third LED 18*c*. The high beam condensed light distribution pattern 31 is an area of high-intensity light which is called "hot zone." A high beam diffusion light distribution pattern 32 is formed by light reflected by the reflective surface 19*a* of the high beam diffusing reflector 16*a* after being emitted from the first LED 18*a*, so as to cover the high beam condensed light distribution pattern 31. The high beam diffusion light distribution pattern 32 is wider than the high beam condensed light distribution pattern 31 both in the direction of the horizontal line H-H and the direction of the vertical line V-V. The high beam condensed light distribution pattern 31 may be, e.g., an area of about ±10° to 15° in the direction of the horizontal line H-H and about ±3° to 5° in the direction of the vertical line V-V. The high beam diffusion light distribution pattern 32 may be, e.g., an area of about ±25° to 35° in the direction of the horizontal line H-H and about ±8° to 10° in the direction of the vertical line V-V. The high beam light distribution pattern 30 is formed by superimposing the high beam condensed light distribution pattern 31 and the high beam diffusion light distribution pattern 32.

Figure 4:
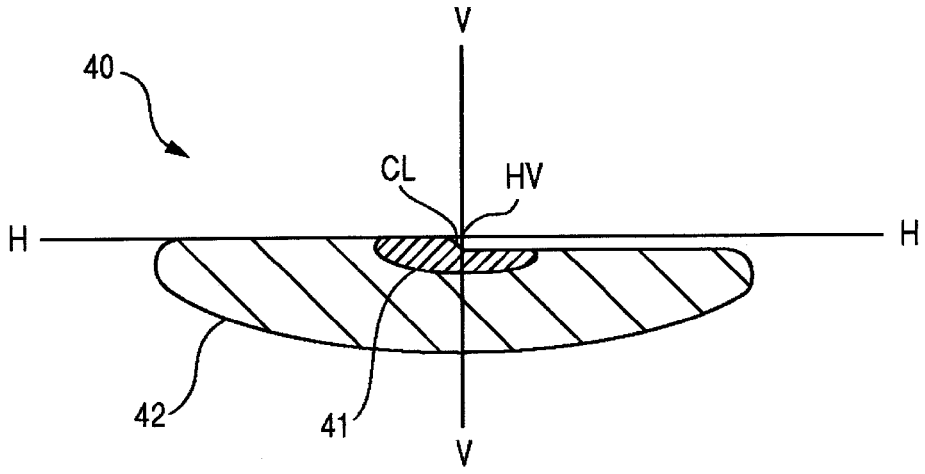
FIG. 4 is a diagram showing a low beam light distribution pattern that is formed ahead of the lamp by a low beam lamp unit.
Figure 5A:
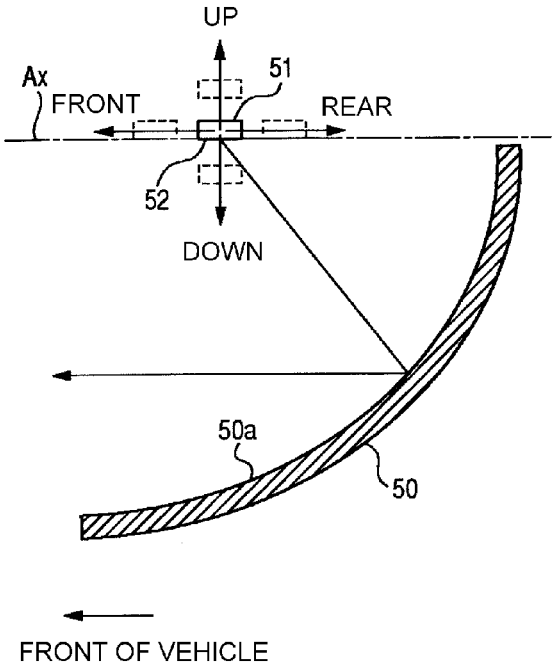
FIGS. 5(*a*) to 5(*e*) are diagrams illustrating the relation between variation in attachment position of an LED and variation in light distribution pattern.
Figure 5B:
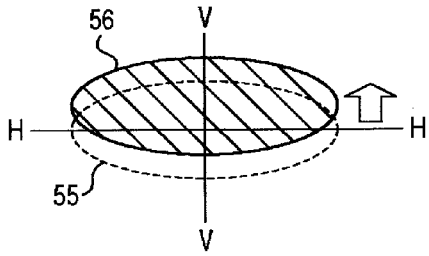
Figure 5C:
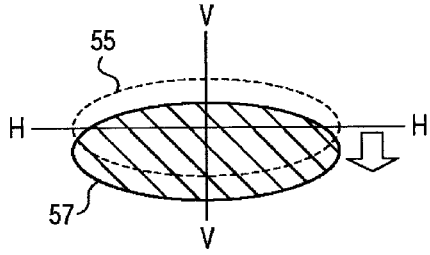
Figure 5D:
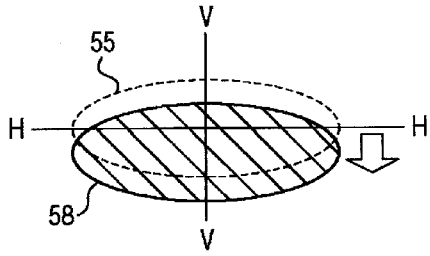
Figure 5E:
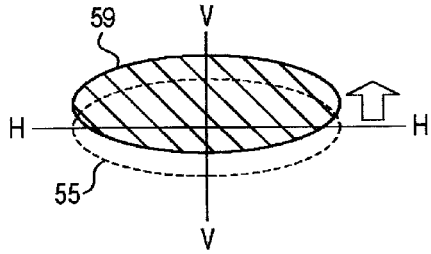

The low beam reflector unit 17 and the fourth to sixth LEDs 18*d* to 18*f* form a low beam lamp unit that radiates low beams. FIG. 4 shows a low beam light distribution pattern 40 that is formed ahead of the lamp by the low beam lamp unit. The low beam light distribution pattern is a light distribution pattern having a cut-off line of a predetermined shape.

A low beam condensed light distribution pattern 41 is formed around the point H-V by light reflected by the reflective surface 20*b* of the first low beam condensing reflector 17*b* after being emitted from the fifth LED 18*e* and light reflected by the reflective surface 20*c* of the second low beam condensing reflector 17*c* after being emitted from the sixth LED 18*f*. The low beam condensed light distribution pattern 41 is an area of high-intensity light which is called "hot zone," and has a cut-off line CL of a predetermined shape. A low beam diffusion light distribution pattern 42 is formed by light reflected by the reflective surface 20*a* of the low beam diffusion reflector 17*a* after being emitted from the fourth LED 18*d*, so as to cover the low beam condensed light distribution pattern 41. The low beam diffusion light distribution pattern 42 is wider than the low beam condensed light distribution pattern 41 both in the direction of the horizontal line H-H and the direction of the vertical line V-V. The low beam condensed light distribution pattern 41 may be, e.g., an area of about ±10° to 15° in the method of the horizontal line H-H and about 0° to −5° in the direction of the vertical line V-V. The low beam diffusion light distribution pattern 42 may be, e.g., an area of about ±25° to 45° in the method of the horizontal line H-H and about 0° to −10° in the direction of the vertical line V-V. The low beam light distribution pattern 40 is formed by superimposing the low beam condensed light distribution pattern 41 and the low beam diffusion light distribution pattern 42.

In one or more embodiments of the present invention, the light source attachment flat surface 21 of the circuit board 15 is tilted with respect to the optical axis of each reflector so as to be higher on the front side of the lamp than on the rear side thereof, as shown in FIG. 2. A light-emitting surface of each LED provided on the light source attachment flat surface 21 is also tilted accordingly with respect to the optical axis of each reflector. Since the optical axis of each reflector extends in the longitudinal direction of the vehicle (horizontal direction), an optical axis of each LED which is perpendicular to the light-emitting surface is tilted with respect to the vertical direction of the vehicle (vertical direction). Effects of tilting the light source attachment flat surface 21 with respect to the optical axis of each reflector in this manner will be described below.

FIGS. 5(*a*) to 5(*e*) are diagrams illustrating the relation between variation in attachment position of the LED and variation in light distribution pattern. FIG. 5(*a*) shows variation in position of an LED 51 with respect to a reflector 50. In the case where the LED 51 is located at a predetermined attachment position 52, a reflective surface 50*a* of the reflector 50 reflects light from the LED 51 in a direction parallel to an optical axis Ax. In this case, an ideal light distribution pattern 55 about the point H-V is radiated to the front of the lamp, as shown by dotted line in FIGS. 5(*b*) to 5(*e*).

In the case where the LED 51 is shifted forward from the predetermined predetermined attachment position 52, a light distribution pattern 56 shifted upward from the ideal light distribution pattern 55 is radiated to the front of the lamp, as shown in FIG. 5(*b*).

If the LED 51 is shifted rearward from the predetermined attachment position 52, a light distribution pattern 57 shifted downward from the ideal light distribution pattern 55 is radiated to the front of the lamp, as shown in FIG. 5(*c*).

If the LED 51 is shifted upward from the predetermined attachment position 52, a light distribution pattern 58 shifted downward from the ideal light distribution pattern 55 is radiated to the front of the lamp, as shown in FIG. 5(*d*).

If the LED 51 is shifted downward from the predetermined attachment position 52, a light distribution pattern 59 shifted upward from the ideal light distribution pattern 55 is radiated to the front of the lamp, as shown in FIG. 5(*e*).

The inventor of the present application examined such a relation between variation in attachment position of the LED 51 and variation in light distribution pattern, and found out that, if the LED 51 was shifted forward from the predetermined attachment position 52, shifting the LED 51 upward from the predetermined attachment position 52 could suppress a shift in position of the light distribution pattern from the ideal light distribution pattern 55 because the variations in light distribution pattern resulting from the forward shift and the upward shift cancel each other (see FIGS. 5(*b*) and 5(*d*)). The inventor of the present application also found out that, if the LED 51 was shifted rearward from the predetermined attachment position 52, shifting the LED 51 downward from the predetermined attachment position 52 could suppress a shift in position of the light distribution pattern from the ideal light distribution pattern 55 because the variations in light distribution pattern resulting from the rearward shift and the downward shift cancel each other (see FIGS. 5(*c*) and 5(*e*)). In the vehicular lamp 10 according to one or more embodiments of the present invention, the light source attachment flat surface is tilted with respect to the optical axis of the reflector based on the above examination.

Figure 6:
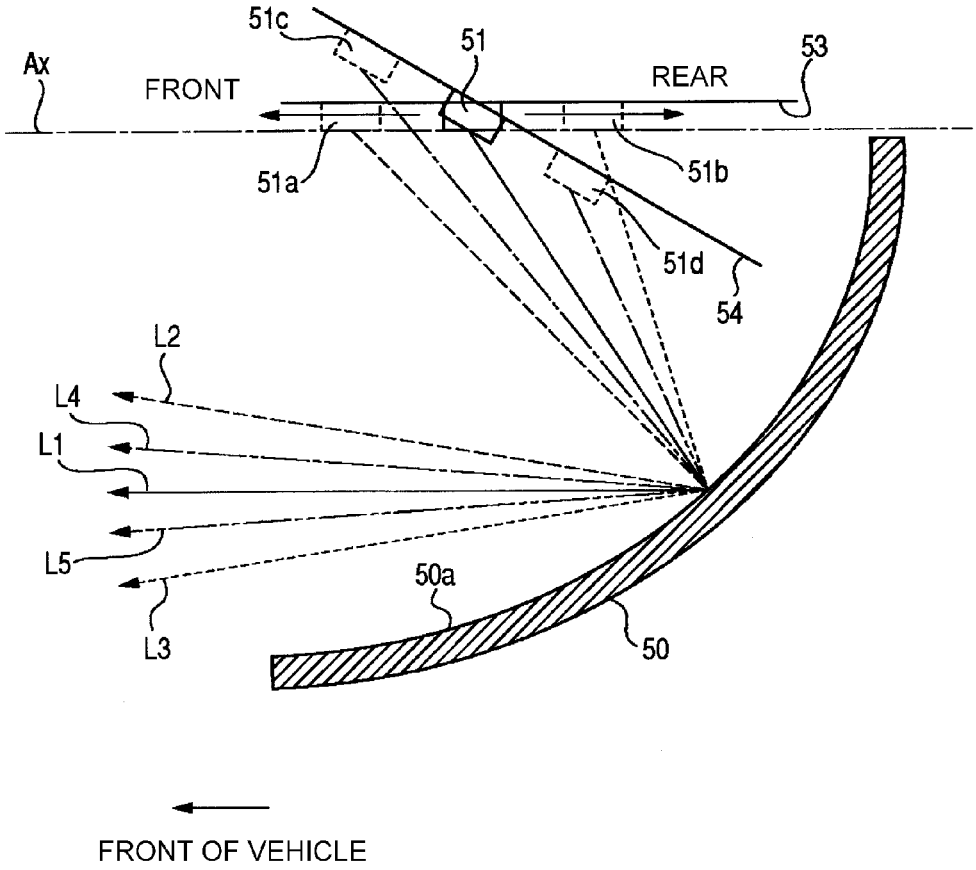
FIG. 6 is a diagram illustrating how the direction of a light ray that is reflected from a reflector varies according to variation in attachment position of the LED.

FIG. 6 is a diagram illustrating how the direction of a light ray that is reflected from the reflector varies according to variation in attachment position of the LED. In FIG. 6, a light source attachment flat surface 53 is parallel to the optical axis Ax of the reflector 50, like conventional typical vehicular lamps. On the other hand, a light source attachment flat surface 54 is tilted with respect to the optical axis Ax of the reflector 50 so as to be higher on the front side of the lamp than on the rear side thereof, like the vehicular lamp 10 according to one or more embodiments of the present invention.

FIG. 6 shows by solid line a light ray L1 that is emitted from the LED 51 and is reflected at a certain point on the reflective surface 50*a* of the reflector 50 in the case where the LED 51 is attached to a predetermined attachment position. This light ray L1 is parallel to the optical axis Ax of the reflector 50.

In the case of employing the light source attachment flat surface 53 parallel to the optical axis Ax of the reflector 50 as in the conventional examples, a light ray L2 (broken line) emitted from an LED 51*a* shifted forward from the predetermined attachment position and reflected at the certain point on the reflective surface 50*a* of the reflector 50 is significantly shifted upward with respect to the light ray L1. A light ray L3 (dotted line) emitted from an LED 51*b* shifted rearward from the predetermined attachment position and reflected at the certain point on the reflective surface 50*a* of the reflector 50 is significantly shifted downward with respect to the light ray L1.

On the other hand, in the case of employing the light source attachment flat surface 54 tilted with respect to the optical axis Ax of the reflector 50 as in one or more embodiments of the present invention, a light ray L4 (chain line) emitted from an LED 51*c* shifted obliquely upward and forward from the predetermined attachment position and reflected at the certain point on the reflective surface 50*a* of the reflector 50 is shifted upward with respect to the light ray L1, but the shift angle is smaller than that of the light ray L2. A light ray L5 (two-dot chain line) emitted from an LED 51*d* shifted obliquely downward and rearward from the predetermined attachment position and reflected at the certain point on the reflective surface 50*a* of the reflector 50 is shifted downward with respect to the light ray L1, but the shift angle is smaller than that for the light ray L3.

As described above, according to the vehicular lamp 10 of one or more embodiments of the present invention, the light source attachment flat surface is tilted with respect to the optical axis of the reflector so as to be higher on the front side of the lamp than on the rear side thereof. This can suppress a shift in direction of the light ray even if the mount position of the LED is shifted from the predetermined attachment position. This is because the light source attachment flat surface tilted with respect to the optical axis of the reflector shifts the light ray upward if the LED is shifted forward from the predetermined attachment position, and shifts the light ray downward if the LED is shifted rearward from the predetermined attachment position. This can suppress the shift angle of the direction of the light ray due to the shift in position of the LED, and can suppress a shift in position of the light distribution pattern that is radiated to the front of the lamp.

In the case where a plurality of reflectors are formed integrally or a plurality of LEDs are mounted on a single common circuit board as in the vehicular lamp 10 of one or more embodiments of the present invention, it is difficult to adjust the attitude of each reflector to set the direction of the light ray that is emitted from each reflector to an ideal direction. If the attachment positions of a part or all of the LEDs are shifted from their predetermined positions, particularly a part of the light distribution pattern which is located around the point H-V and which should have high light intensity becomes dark. This may reduce long-distance visibility. However, according to the vehicular lamp 10 of one or more embodiments of the present invention, a shift in position of the light distribution pattern can be suppressed. This can ensure high light intensity in the area around the point H-V and can prevent reduction in long-distance visibility.

Although the lower surface of the circuit board 15 serves as the light source attachment flat surface 21 in one or more embodiments of the present invention, the light source attachment flat surface 21 is not limited to the surface of the circuit board 15, and may be, e.g., a flat surface of a heat sink.

Figure 7:
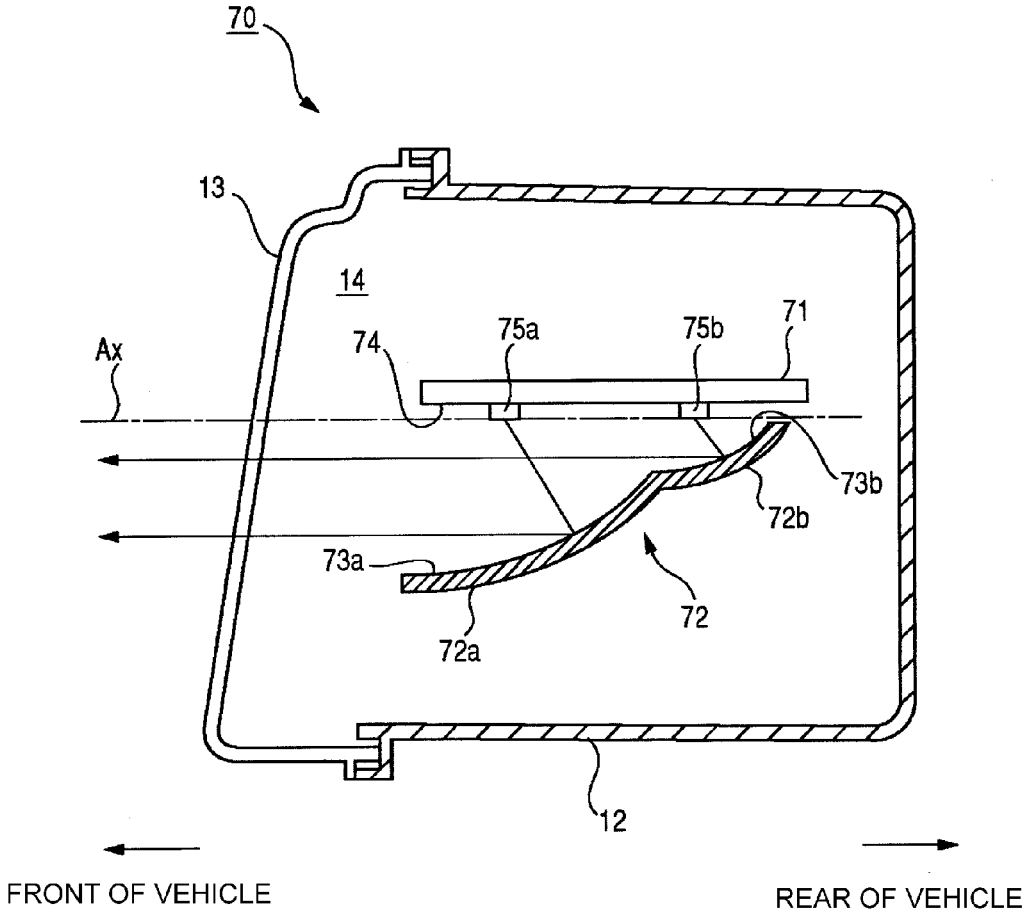
FIG. 7 is a vertical sectional view of a vehicular lamp according to one or more embodiments of the present invention.

FIG. 7 is a vertical sectional view of a vehicular lamp 70 according to one or more embodiments of the present invention. The vehicular lamp 70 shown in FIG. 7 is also a single headlamp that is placed on each of the right and left side of the front part of the vehicle.

As shown in FIG. 7, the vehicular lamp 70 accommodates a circuit board 71, high beam reflector units 72, and low beam reflector units (not shown) in a lamp chamber 14 that is formed by a lamp body 12 and an outer cover 13. Each of the circuit board 71 and the high beam reflector units 72 is fixed to the lamp body 12 by a support member, not shown.

Figure 8:
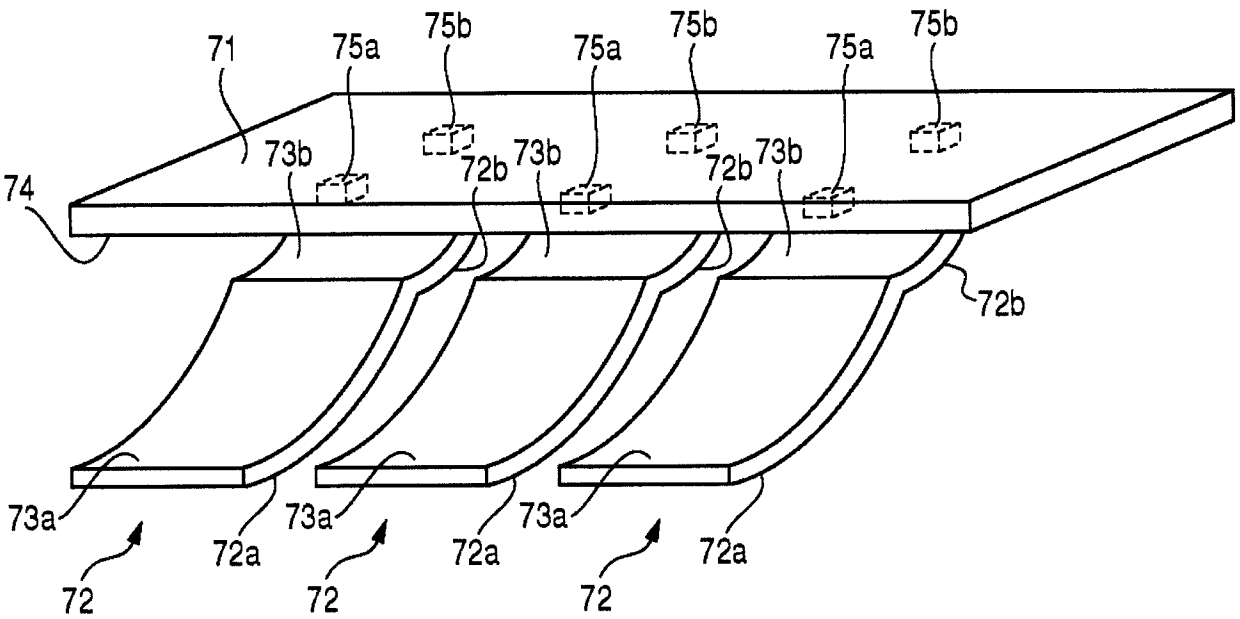
FIG. 8 is a perspective view of a circuit board and high beam reflector units.

FIG. 8 is a perspective view of the circuit board 71 and the high beam reflector unit 72. As shown in FIG. 8, three high beam reflector units 72 are arranged side by side below the circuit board 71 in the lateral direction of a vehicle. Although not shown in the figure, the plurality of low beam reflector units are also arranged side by side below the circuit board 71 in the lateral direction of the vehicle.

Each high beam reflector unit 72 is formed by two parabolic reflectors, namely a high beam diffusing reflector 72*a* and a high beam condensing reflector 72*b*. These two reflectors are formed integrally. In one or more embodiments of the present invention, the high beam diffusing reflector 72*a* and the high beam condensing reflector 72*b* are arranged side by side in the vertical direction. As shown in FIGS. 7 and 8, the high beam condensing reflector 72*b* extends obliquely downward and forward from a position in the vicinity of the rear part of the circuit board 71. The high beam diffusing reflector 72*a* extends obliquely downward and forward from the front end of the high beam condensing reflector 72*b*.

The high beam diffusing reflector 72*a* and the high beam condensing reflector 72*b* respectively have reflective surfaces 73*a* and 73*b* each formed based on a paraboloid of revolution. The rotation central axis of each paraboloid of revolution is an optical axis of a corresponding one of the reflectors. The high beam diffusing reflector 72*a* and the high beam condensing reflector 72*b* have a common optical axis Ax. The high beam diffusing reflector 72*a* and the high beam condensing reflector 72*b* are placed so that the optical axis Ax extends in the longitudinal direction of the vehicle (horizontal direction). In one or more embodiments of the present invention, the f-number (F2) of the reflective surface 73*b* of the high beam condensing reflector 72*b* is smaller than that (F1) of the reflective surface 73*a* of the high beam diffusing reflector 72*a*. F2/F1 may be, e.g., about ⅓ to ½.

Six LEDs are mounted on the circuit board 71. Six light source attachment portions are formed on a light source attachment flat surface 74 as the lower surface of the circuit board 71 in order to mount these six LEDs thereon. Three of the six LEDs are diffusing LEDs 75*a* that are used to emit light to the high beam diffusing reflectors 72*a*, and the remaining three LEDs are condensing LEDs 75*b* that are used to emit light to the high beam condensing reflectors 72*b*.

The diffusing LED 75*a* is placed at a focal point of the reflective surface 73*a* of the high beam diffusing reflector 72*a*. The condensing LED 75*b* is placed at a focal point of the reflective surface 73*b* of the high beam condensing reflector 72*b*. Each reflector reflects light from a corresponding one of the LEDs in a direction parallel to the optical axis Ax. The diffusing LED 75*a* is placed in the front part of the lamp and the condensing LED 75*b* is placed in the rear part of the lamp on the light source attachment flat surface 74.

A high beam condensed light distribution pattern is formed around the point H-V ahead of the vehicle by light reflected by the reflective surfaces 73*b* of the high beam condensing reflectors 72*b* after being emitted from the condensing LEDs 75*b* (see FIG. 3). A high beam diffusion light distribution pattern is formed by light reflected by the reflective surfaces 73*a* of the high beam diffusing reflectors 72*a* after being emitted from the diffusing LEDs 75*a*, so as to cover the high beam condensed light distribution pattern. In one or more embodiments of the present invention, a high beam light distribution pattern is formed by superimposing the high beam condensed light distribution pattern and the high beam diffusion light distribution pattern which are formed by the three high beam reflector units 72.

In the case where the high beam diffusing reflector and the high beam condensing reflector are arranged side by side in the vertical direction, separate circuit boards for mounting of the LEDs are normally required for the individual reflectors. This may increase the size in the height direction of the vehicular lamp (vertical direction of the vehicle) in view of the thickness of the circuit boards and clearance between the circuit boards for wiring. According to the vehicular lamp 70 of one or more embodiments of the present invention, the diffusing LED 75*a* and the condensing LED 75*b* can be mounted on the single circuit board 71, the size in the height direction of the vehicular lamp can be suppressed even if the high beam diffusing reflector and the high beam condensing reflector are arranged side by side in the vertical direction.

Although the configuration of the high beam reflector unit 72 is primarily described above, the low beam reflector unit can be configured similarly. The optical system used in the vehicular lamp 70 of one or more embodiments of the present invention can also be used in marker lamps such as a turn signal lamp and a daytime running lamp.

Figure 9:
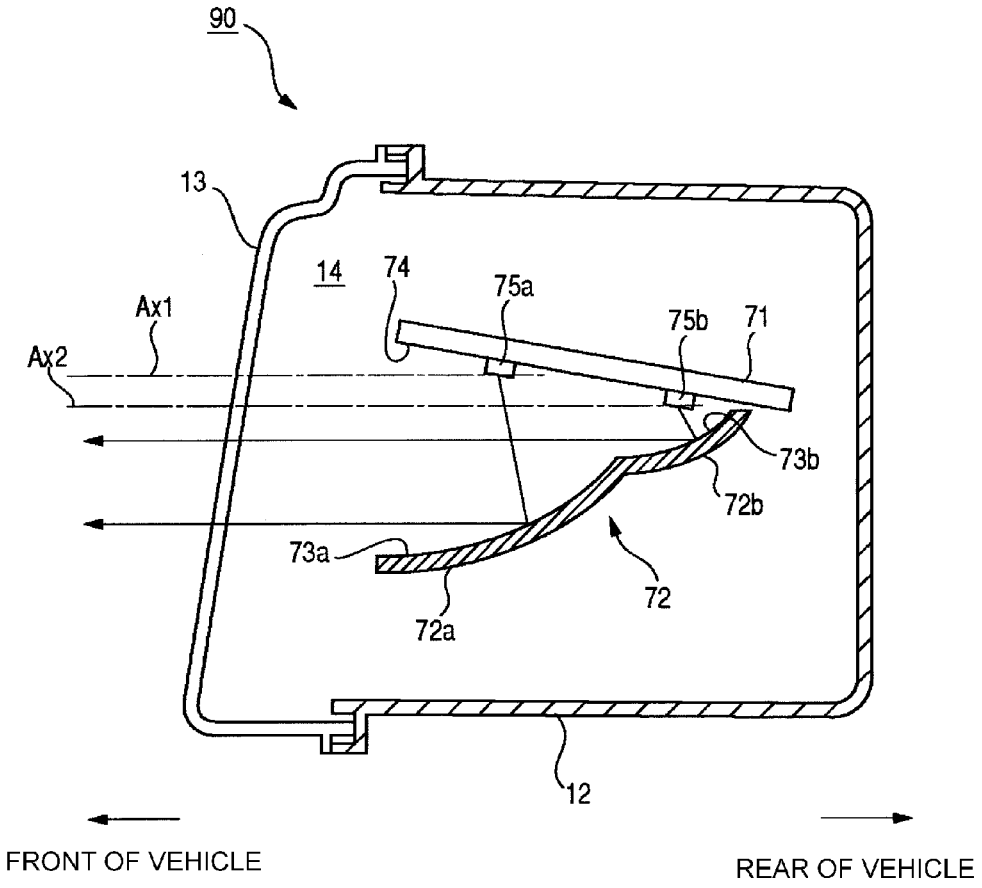
FIG. 9 is a diagram illustrating a modification of the vehicular lamp shown in FIG. 7.

FIG. 9 is a diagram illustrating a modification of the vehicular lamp shown in FIG. 7. In a vehicular lamp 90 according to the modification, as in the vehicular lamp 10 shown in FIG. 1, the light source attachment flat surface 74 of the circuit board 71 is tilted with respect to a first optical axis Ax1 of the high beam diffusing reflector 72*a* and a second optical axis Ax2 of the high beam condensing reflector 72*b* so as to be higher on the front side of the lamp than on the rear side thereof. This configuration can suppress the size in the height direction of the vehicular lamp, and can suppress a shift in position of the light distribution pattern due to a shift in position of the LED.

The present invention is described above based on embodiments. It should be understood by those skilled in the art that these embodiments are by way of example only, various modifications can be made to combinations of the components and the processes, and such modifications fall within the scope of the present invention.

For example, although the LED is shown as a light source in one or more of the above embodiments, the light source is not limited to the LED, and may be, e.g., a semiconductor laser, a bulb, etc.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS

10, 70, 90 VEHICULAR LAMP
12 LAMP BODY
13 OUTER COVER
14 LAMP CHAMBER
15, 71 CIRCUIT BOARD
16, 72 HIGH BEAM REFLECTOR UNIT
17 LOW BEAM REFLECTOR UNIT
21, 53, 54, 74 LIGHT SOURCE ATTACHMENT FLAT SURFACE
30 HIGH BEAM LIGHT DISTRIBUTION PATTERN
31 HIGH BEAM CONDENSED LIGHT DISTRIBUTION PATTERN
32 HIGH BEAM DIFFUSION LIGHT DISTRIBUTION PATTERN
40 LOW BEAM LIGHT DISTRIBUTION PATTERN
41 LOW BEAM CONDENSED LIGHT DISTRIBUTION PATTERN
50 REFLECTOR
51 LED

The invention claimed is:

1. A vehicular lamp comprising:
a light source attachment flat surface that faces downward, and that comprises having a plurality of light source attachment portions;
a plurality of light sources attached to the plurality of light source attachment portions; and
a plurality of parabolic reflectors,
wherein each of the plurality of parabolic reflectors reflects light from a corresponding one of the light sources in a predetermined optical axis direction, and
wherein the light source attachment flat surface is tilted with respect to an optical axis of the plurality of reflectors so as to be higher on a front side of the lamp than on a rear side of the lamp.

2. The vehicular lamp according to claim 1,
wherein the light source attachment flat surface comprises:
a first light source attachment portion to which a first light source of the plurality of light sources is attached, and
a second light source attachment portion to which a second light source of the plurality of light sources is attached,
wherein the plurality of reflectors comprises:
a first reflector that reflects light from the first light source, and
a second reflector that reflects light from the second light source,
wherein the first reflector extends from a front end of the second reflector toward a front of the lamp, and
wherein the first light source attachment portion and the second light source attachment portion are placed on the light source attachment flat surface so that the first light source is placed at a focal point of the first reflector and the second light source is placed at a focal point of the second reflector.

3. The vehicular lamp according to claim 2, wherein an f-number of a reflective surface of the second reflector is smaller than an f-number of a reflective surface of the first reflector.

4. A vehicular lamp, comprising:
a light source attachment flat surface comprising a first light source attachment portion and a second light source attachment portion;

a first light source attached to the first light source attachment portion;

a second light source attached to the second light source attachment portion;

a parabolic first reflector that reflects light from the first light source to a front of the lamp; and a parabolic second reflector that reflects light from the second light source to the front of the lamp, wherein the first reflector extends from a front end of the second reflector toward the front of the lamp, and wherein the first light source attachment portion and the second light source attachment portion are placed on the light source attachment flat surface so that the first light source is placed at a focal point of the first reflector and the second light source is placed at a focal point of the second reflector.

5. The vehicular lamp according to claim 4, wherein an f-number of a reflective surface of the second reflector is smaller than an f-number of a reflective surface of the first reflector.

* * * * *